US010337393B2

(12) United States Patent
Hurst et al.

(10) Patent No.: US 10,337,393 B2
(45) Date of Patent: Jul. 2, 2019

(54) DIRT TRAP AS A FUNCTIONAL MODULE IN THE IMPELLER OF A COOLANT PUMP

(71) Applicant: Schaeffler Technologies AG & Co. KG, Herzogenaurach (DE)

(72) Inventors: Sebastian Hurst, Bubenreuth (DE); Michael Weiss, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 98 days.

(21) Appl. No.: 14/608,554

(22) Filed: Jan. 29, 2015

(65) Prior Publication Data

US 2015/0219003 A1 Aug. 6, 2015

(30) Foreign Application Priority Data

Feb. 3, 2014 (DE) ..... 10 2014 201 880

(51) Int. Cl.
*F01P 11/06* (2006.01)
*F04D 29/22* (2006.01)
(Continued)

(52) U.S. Cl.
CPC ..... *F01P 11/06* (2013.01); *F01P 3/02* (2013.01); *F01P 5/12* (2013.01); *F04D 29/2288* (2013.01);
(Continued)

(58) Field of Classification Search
CPC ..... F01P 11/06; F01P 5/12; F01P 5/10; F01P 2011/065; F04D 29/2288; F04D 29/708;
(Continued)

(56) References Cited

U.S. PATENT DOCUMENTS 3,838,901 A * 10/1974 Sampatacos ..... F01P 5/12 384/481
2010/0252081 A1* 10/2010 Classen ..... A47L 15/4206 134/110
(Continued)

FOREIGN PATENT DOCUMENTS

CN 102149923 A 8/2011
CN 102418711 A 4/2012
(Continued)

*Primary Examiner* — Lindsay M Low
*Assistant Examiner* — Omar Morales
(74) *Attorney, Agent, or Firm* — Volpe and Koenig, P.C.

(57) ABSTRACT

A coolant pump (1) of an internal combustion engine, having a pump casing (2), in which a pump shaft (3) is rotatably supported by a water pump bearing assembly (4) and an impeller (6) connected in a rotationally fixed manner to the pump shaft (3) is associated with an intake space (7). During a rotation of the impeller (6) together with associated blades (8), a coolant as a working medium is pumped from the intake space (7), via a coolant outlet of the coolant pump (1), into a cooling system of the internal combustion engine. A dirt trap is associated as a functional module (12*a*) with the impeller (6) on a side facing away from the intake space (7), wherein the working medium flows into the functional module (12*a*) from the intake space via at least one opening (13) introduced into the impeller and emerges via a flow outlet (15*a*).

9 Claims, 2 Drawing Sheets

(51) Int. Cl.
*F04D 29/70* (2006.01)
*F01P 3/02* (2006.01)
*F01P 5/12* (2006.01)

(52) U.S. Cl.
CPC ..... *F04D 29/708* (2013.01); *F01P 2003/021* (2013.01); *F01P 2003/024* (2013.01); *F01P 2011/063* (2013.01)

(58) Field of Classification Search
CPC ..... F16J 15/3264; F16J 15/324; F16J 15/00; F16J 15/32; F16C 33/7883; F16C 33/80
USPC ..... 123/41.47; 277/411, 409, 346
See application file for complete search history.

(56) References Cited

U.S. PATENT DOCUMENTS

| | | | |
|---|---|---|---|
| 2011/0162597 | A1 | 7/2011 | Draheim et al. |
| 2012/0076640 | A1 | 3/2012 | Popp et al. |
| 2013/0081583 | A1 | 4/2013 | Weiss et al. |

FOREIGN PATENT DOCUMENTS

| | | | | |
|---|---|---|---|---|
| CN | 103032341 | A | 4/2013 | |
| DE | 19643794 | | 2/1998 | |
| DE | 10057099 | | 6/2002 | |
| DE | 102008022354 | | 11/2009 | |
| DE | 102009048349 | | 11/2010 | |
| DE | 102011012826 | | 1/2012 | |
| WO | WO 2010069703 | A1 * | 6/2010 | ..... F16C 33/7883 |

* cited by examiner

DIRT TRAP AS A FUNCTIONAL MODULE IN THE IMPELLER OF A COOLANT PUMP

INCORPORATION BY REFERENCE

The following documents are incorporated herein by reference as if fully set forth: German Patent Application No. 102014201880.3, filed Feb. 3, 2014.

BACKGROUND

The present invention relates to a coolant pump of an internal combustion engine, having a pump casing, in which a pump shaft is rotatably supported by a water pump bearing assembly. An impeller connected in a rotationally fixed manner to the pump shaft is associated with an intake space. During a rotation of the impeller together with the associated blades, a coolant as a working medium is pumped in a fluid or volume flow from the intake space, via a coolant outlet of the coolant pump, into a cooling system of the internal combustion engine.

In the case of liquid-cooled internal combustion engines, the coolant, in particular cooling water, is pumped in a preferably closed circuit through cooling passages in the region of the cylinders and of the cylinder head with the aid of a coolant pump in order to cool the internal combustion engine. The heated medium is then re-cooled in an air/water heat exchanger by a fan and/or by the relative airflow. The coolant pump used to circulate the coolant is normally driven by an accessory drive mounted in front of the crankcase or by a timing drive inserted within the crankcase.

Document DE 100 57 099 C2 discloses a coolant pump which is used to deliver coolant in internal combustion engines and comprises a pump shaft which is rotatably mounted in a pump casing and, at one end, carries an impeller which rotates in a flow or intake space of the pump casing. At the opposite end from the impeller, the pump shaft is driven by a belt pulley, which is connected for conjoint rotation to the shaft and is driven via a belt by a rotating component of the internal combustion engine. To protect the bearing assembly from the coolant and from impurities, a mechanical seal is provided between the bearing assembly of the pump shaft and the pump space supplied with coolant. The cooling systems of contemporary internal combustion engines for vehicles do not contain a filter system or any device or measures for removing impurities from the coolant.

SUMMARY

It is the underlying object of the invention to integrate into a coolant pump a functional module by which functionally reliable, long-lasting and low-cost cleaning of the coolant in a manner optimized in terms of installation space can be achieved.

The abovementioned objective is met using one or more features of the invention. Advantageous embodiments of the invention are presented below and in the claims.

According to the invention, a coolant pump is provided which, on a side of the impeller facing away from the intake space, provides a functional module constructed as a dirt trap. Via at least one opening introduced into the impeller, the coolant or working medium flows into the functional module and can then flow out via a flow outlet. Through the concept according to the invention, a partial quantity of the coolant is continuously filtered in the operating state of the coolant pump, thereby continuously filtering impurities out of the coolant. By use of the invention, it is advantageously possible, for example, effectively to remove contaminants that have entered the coolant through the production process or the assembly of the internal combustion engine, e.g. molding sand remaining from the casting process for the crankcase, metal chips, dissolved particles, residues and other foreign bodies. The long-term and economically achievable cleaning of the coolant by the measure according to the invention furthermore improves functional reliability since the risk of erosion that can occur in the range of high flow rates in the cooling system in the case of uncleaned coolant is eliminated. By virtue of the structural design of the functional module associated with the impeller, the centrifugal forces can be used, as a result of which dirt particles collect in a centrifugal force field in the region of an inner circumference of the functional module designed as a dirt trap due to their higher density in the coolant which has flowed in, before the cleaned coolant can emerge.

It is precisely with regard to novel cooling systems, the operation of which depends on intact sealing surfaces of the seals and on switching thermostats, for example, that the invention offers a concept by which a desirable coolant that is free from dirt particles can be achieved, thereby significantly minimizing the probability of failure of individual components. The invention, in which the functional module is arranged on the side facing away from the intake space, can advantageously be combined with axially extending relief bores, which are introduced into modern impellers in order to reduce a level of axial force on the impeller and hence on the water pump bearing assembly. To avoid a buildup effect, which would prevent flow through the impeller openings, also referred to as relief bores, and the cleaning effect of the functional module, this includes at least an adequately dimensioned flow outlet. The position of the flow outlet is chosen so that it is not permanently covered by the accumulated dirt particles. Moreover, it is advantageously possible with the concept according to the invention to comply with or to better more stringent limits for residual dirt in cooling systems, especially in internal combustion engines for passenger vehicles.

According to an advantageous embodiment of the invention, the functional module is constructed as a dirt trap of basket- or screen-like construction. The functional module, which has a sufficient reservoir or volume to accommodate the dirt particles, forms an effective separating and collecting element. On the other hand, the functional module is distinguished by a low flow resistance, allowing optimum approach flow and through flow of coolant.

As a measure for improving the filtering effect and hence the removal rate of the functional module, provision is made according to the invention to position both the opening forming a flow inlet and the flow outlet in a corresponding manner close to the pump shaft in the functional module. Here, the flow outlet is preferably introduced within the contour of the functional module.

A preferred solution of the invention which is optimized in terms of installation space envisages integrating the functional module within an existing contour of the impeller. By this neutral arrangement in terms of installation space, the dirt trap or functional module can be introduced into the impeller before the impeller is inserted into the casing of the coolant pump to complete assembly. Consequently, there is a further cost advantage since the dirt trap does not have to be handled as an additional component requiring a separate assembly step. An expedient way of forming a functional module which can be produced at low cost is to introduce a rotationally symmetrical recess into the front side of the impeller, preferably by a machining process. The recess of rotationally symmetrical configuration intended to receive the dirt particles is closed by a cover element with an integrated flow outlet. As an alternative, a perforated cover element or a screen disk can be inserted as a flow outlet.

According to the invention, a separate component can furthermore be positioned as a functional module behind the impeller of the coolant pump. Particularly suitable for this purpose is a functional module of pot-shaped configuration which is fixed in a sealed manner and, in particular, materially, on the impeller by way of a cylindrical sleeve. A disk-type end wall, preferably embodied in the form of a screen, connects the outer sleeve to a bushing guided on the pump shaft. In the operating state, the inflowing coolant impinges within the functional module upon the, preferably perforated, screen-type end wall, which forms a baffle. Due to the centrifugal force of the rotating impeller, the dirt particles or foreign bodies will settle on the inside of the tubular sleeve owing to their higher density before the cleaned coolant flows out of the functional module.

According to the invention, the functional module forming a separate component is produced from a metallic material or from a temperature-stable and acid-resistant plastic.

Durable fixing of the prefabricated functional module forming a dirt trap is accomplished, on the one hand, by a press fit of the central bushing of the end wall on the pump shaft and, on the other hand, by a material connection of the sleeve to the impeller.

According to another embodiment of the invention, the flow outlet of the functional module comprises a filter element. Here, the mesh width of the filter element defines a dirt particle size that can be separated out of the coolant of the cooling system. As an alternative to a local flow outlet, it is also possible for the perforated or screen-like end wall of the separate functional module or the screen disk of the functional module integrated into the impeller to have an appropriately defined mesh width to be able to clean the coolant as intended.

BRIEF DESCRIPTION OF THE DRAWINGS

Further features of the invention will emerge from the following description of the drawings, in which illustrative embodiments of the invention are shown. The embodiments illustrated show examples of solutions according to the invention, but these do not represent a definitive delimitation of the invention. In the drawings.

DETAILED DESCRIPTION OF THE PREFERRED EMBODIMENTS

Figure 1:
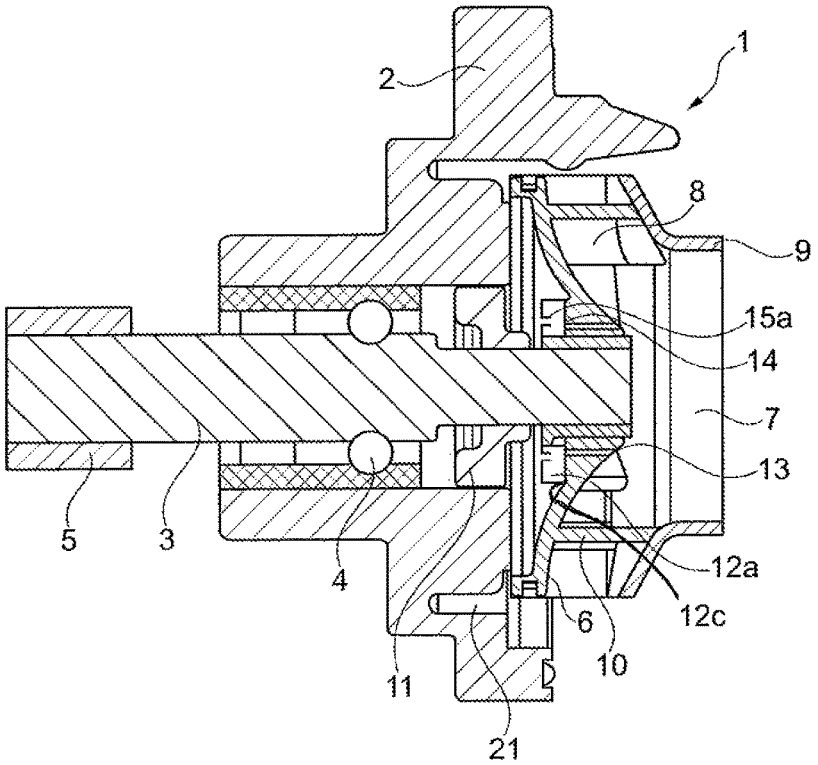
FIG. 1 shows a section through a coolant pump having a functional module according to the invention.

FIG. 1 shows a coolant pump 1 for a cooling circuit of an internal combustion engine (not shown) having a pump casing 2, in which a drivable pump shaft 3 is rotatably supported by a water pump bearing 4 embodied as a rolling bearing. The coolant pump 1 is driven, in particular, via a belt pulley 5 connected integrally to the pump shaft 3. An impeller 6 is secured in a rotationally fixed manner on one end of the pump shaft 3, said impeller having blades 8, which project into an intake space 7, and a front-side covering disk 9, which are connected to one another by axially aligned ribs 10 arranged in a circumferentially distributed manner. To seal off the water pump bearing 4 from the pump space or intake space 7, a mechanical seal 11 is provided as a seal. During the rotation of the impeller 6, coolant or fluid is pumped via an intake branch (not shown) of the pump casing 2 into the intake space 7 and, from there, into a discharge branch (not shown). On a side facing away from the intake space 7, the impeller 6 has associated with it a functional module 12*a*, which performs the function of a dirt trap, is supplied with a partial flow of the coolant and in which dirt particles in the coolant are separated out. The functional module 12*a* includes an enclosed space defined by a wall of the impeller blade 8 and a connected portion 12*c* of the functional module attached to the impeller blade wall. For this dirt trap purpose, circumferentially distributed openings 13 designed as bores are introduced into the impeller 6, close to the pump shaft 3. The coolant flowing through the opening 13 passes via a flow inlet 14 into the functional module 12*a*. Due to the rotation and based on a higher density, the dirt particles in the coolant move radially outward along an inner wall of the functional module 12*a*. The cleaned coolant passes via a flow outlet 15*a* of the functional module 12*a* into a pump space 21.

Figure 2:
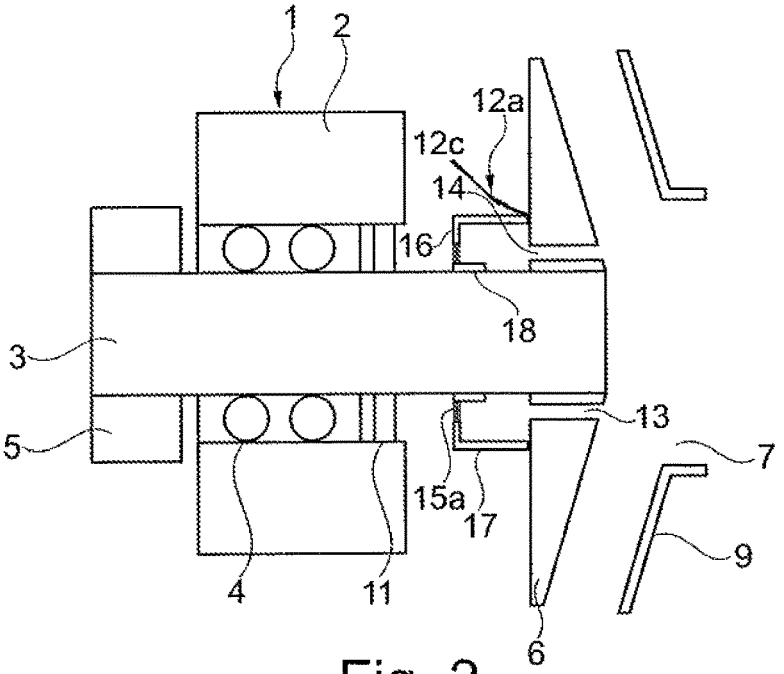
FIG. 2 shows a simplified detail of the coolant pump, the functional module of which is associated as a separate component with the impeller.
Figure 3:
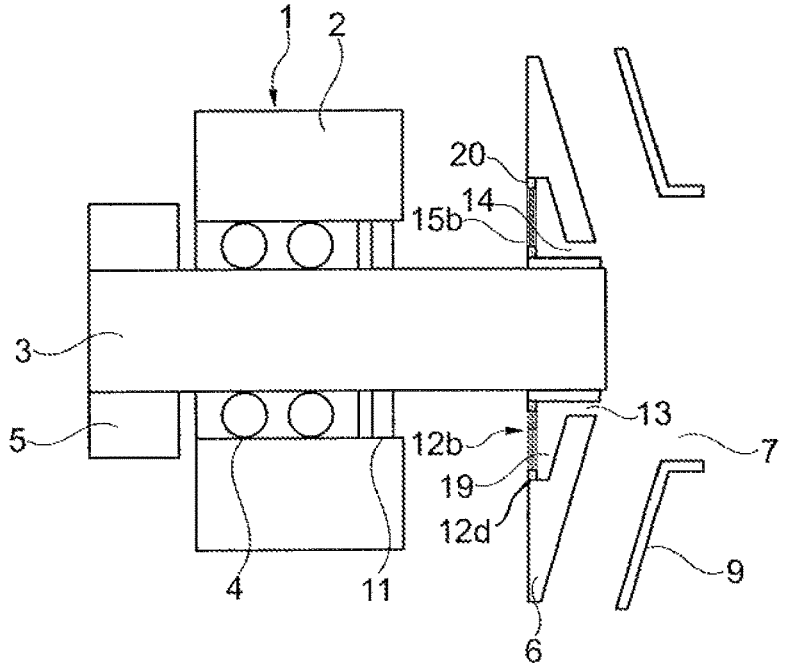
FIG. 3 shows a simplified detail of the coolant pump, the functional module of which is integrated into the impeller.

FIGS. 2 and 3 show simplified detail views of the coolant pump 1. Through the enlarged illustrations, details, in particular, of the differently embodied functional modules 12*a*, 12*b*, each associated with the impeller 6, are made clearer. Here, the reference signs for components or parts which are the same or have the same function correspond to those in FIG. 1. The following descriptions are therefore restricted largely to differences in embodiment essential to the invention.

FIG. 2 shows the enlarged functional module 12*a* according to FIG. 1, which is designed as a pot-shaped part. An end wall 16 of the functional module 12*a*, which is of disk-type configuration, forms a seal on the impeller 6 and is preferably secured materially thereon at the connected portion 12*c* of the functional module, connects an outer sleeve 17 to a bushing 18 fixed in position on the pump shaft 3. In this arrangement, the flow outlet 15*a* in the end wall 16 is designed as a filter with a screen-type structure and a defined mesh width.

In FIG. 3, the impeller 6 is shown with the integrated functional module 12*b* attached to the impeller at a connected portion 12*d*. For this purpose, a rotationally symmetrical recess 19 forming a collecting space is introduced into the impeller 6 on the side facing away from the intake space 7. At the end, the recess 19 is closed by a cover element 20 embodied as a filter with a defined mesh width.

LIST OF REFERENCE SIGNS

1 coolant pump
2 pump casing
3 pump shaft
4 water pump bearing
5 belt pulley
6 impeller
7 intake space
8 blade
9 covering disk
10 rib
11 mechanical seal
12*a*, 12*b* functional module
12*c*, 12*d* connected portion

13 opening
14 flow inlet
15*a*, 15*b* flow outlet
16 end wall
17 sleeve
18 bushing
19 recess
20 cover element
21 pump space

The invention claimed is:

1. A coolant pump of an internal combustion engine, comprising:

a pump casing, a pump shaft rotatably supported in the pump casing by a water pump bearing assembly, and an impeller connected in a rotationally fixed manner to the pump shaft, the impeller is associated with an intake space, wherein a rotation of the impeller, together with associated blades, pumps a coolant as a working medium in a fluid or volume flow from the intake space, via a coolant outlet of the coolant pump, into a cooling system of the internal combustion engine, wherein a functional module is attached to the impeller on a side of the impeller facing away from the intake space, the functional module including an enclosed space defined by a wall of the impeller blade and a connected portion of the functional module attached to the impeller blade wall, wherein the working medium flows into the enclosed space of the functional module from the intake space via at least one opening in the impeller blade wall and exits the enclosed space via a flow outlet formed in the connected portion.

2. The coolant pump as claimed in claim 1, wherein the functional module comprises a dirt trap of basket or screen construction.

3. The coolant pump as claimed in claim 1, wherein the opening and the flow outlet are close to the pump shaft.

4. The coolant pump as claimed in claim 1, wherein the functional module is integrated within an existing contour of the impeller.

5. The coolant pump as claimed in claim 4, wherein the enclosed space of the functional module is formed by a rotationally symmetrical recess formed in a front side of the impeller, said recess being closed by a perforated cover element or a screen disk as the connected portion.

6. The coolant pump as claimed in claim 1, wherein the connected portion is connected to the pump shaft and the impeller in an installed state.

7. The coolant pump as claimed in claim 6, wherein the connected portion has a pot shape with a cylindrical sleeve, which is sealed at the impeller and fixed in position, and a disk-type end wall, which is fixed on the pump shaft via a bushing.

8. The coolant pump as claimed in claim 1, wherein the separate functional module, which is produced from a metallic material or from a plastic, is fixed materially as a prefabricated component on the impeller.

9. The coolant pump as claimed in claim 1, wherein the flow outlet of the connected portion comprises a filter element, a mesh width of which defines a dirt particle size that can be removed from the cooling system.

* * * * *